US011172709B2

(12) United States Patent
Watanabe et al.

(10) Patent No.: US 11,172,709 B2
(45) Date of Patent: Nov. 16, 2021

(54) METHOD FOR PRODUCING VAPOR GENERATION UNIT FOR NON-COMBUSTIBLE FLAVOR INHALER

(71) Applicant: JAPAN TOBACCO INC., Tokyo (JP)

(72) Inventors: Tomoichi Watanabe, Tokyo (JP); Masayoshi Saito, Tokyo (JP); Toshiki Kudo, Tokyo (JP); Hidenori Muramoto, Tokyo (JP); Ryuji Saito, Tokyo (JP); Masayuki Kimura, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 17/234,866

(22) Filed: Apr. 20, 2021

(65) Prior Publication Data

US 2021/0235771 A1 Aug. 5, 2021

Related U.S. Application Data

(63) Continuation of application No. PCT/JP2019/038302, filed on Sep. 27, 2019.

(30) Foreign Application Priority Data

Nov. 27, 2018 (JP) ..... JP2018-221397

(51) Int. Cl.
*A24F 40/70* (2020.01)
*A24F 40/46* (2020.01)
(Continued)

(52) U.S. Cl.
CPC ..... *A24F 40/70* (2020.01); *A24F 40/44* (2020.01); *A24F 40/46* (2020.01); *A24F 40/10* (2020.01)

(58) Field of Classification Search
CPC ..... A24F 40/70
See application file for complete search history.

(56) References Cited

U.S. PATENT DOCUMENTS

| | | | | |
|---|---|---|---|---|
| 10,278,428 | B2 | 5/2019 | Perez et al. | |
| 2021/0127742 | A1* | 5/2021 | Kim | A61M 15/06 |
| 2021/0235771 | A1* | 8/2021 | Watanabe | A24F 40/46 |

FOREIGN PATENT DOCUMENTS

| | | | |
|---|---|---|---|
| JP | 2016-511008 | A | 4/2016 |
| JP | 2017-532064 | A | 11/2017 |

(Continued)

OTHER PUBLICATIONS

International Search Report, issued in PCT/JP2019/038302, dated Dec. 17, 2019.

*Primary Examiner* — James Harvey
(74) *Attorney, Agent, or Firm* — Birch, Stewart, Kolasch & Birch, LLP

(57) ABSTRACT

A method for producing a vapor generation unit, which is for generating a vapor by heating a liquid and is to be used in a non-combustible flavor inhaler, includes: a support feeding step of feeding a wick support to a production line for the vapor generation unit; a wick feeding step of, after the support feeding step, feeding a wick toward the wick support and disposing the same on the wick support; a holder feeding step of, after the wick feeding step, feeding a wick holder toward the wick support and assembling the same on the wick support; and a heater feeding step of, after the holder feeding step, feeding a heater toward the wick holder and assembling the same on the wick support.

14 Claims, 13 Drawing Sheets

(51) Int. Cl.
*A24F 40/44* (2020.01)
*A24F 40/10* (2020.01)

(56) References Cited

FOREIGN PATENT DOCUMENTS

| | | | |
|---|---|---|---|
| WO | WO 2014/150979 | A2 | 9/2014 |
| WO | WO 2017-178465 | A1 | 10/2017 |
| WO | WO 2018-029210 | A1 | 2/2018 |
| WO | WO 2018-146736 | A1 | 8/2018 |

* cited by examiner

METHOD FOR PRODUCING VAPOR GENERATION UNIT FOR NON-COMBUSTIBLE FLAVOR INHALER

CROSS REFERENCE TO RELATED APPLICATIONS

This application is a Continuation of PCT International Application No. PCT/JP2019/038302, filed on Sep. 27, 2019, which claims priority under 35 U.S.C. 119(a) to Patent Application No. 2018-221397, filed in Japan on Nov. 27, 2018, all of which are hereby expressly incorporated by reference into the present application.

TECHNICAL FIELD

The present invention relates to a method for producing a vapor generation unit for a non-combustible flavor inhaler.

BACKGROUND ART

Non-combustible flavor inhalers for inhaling flavor without combustion of a material are known. One example of such inhalers is an electronic cigarette, which includes a vapor generation unit that heats a liquid to generate vapor. As the vapor generated in the vapor generation unit passes through the inhaler, the vapor is cooled to form an aerosol. The aerosol passes through a flavor source before being inhaled.

PTL 1 discloses a method for assembling a cartridge, such as a cartridge for an aerosol delivery device or a cartridge for a smoking article. The cartridge includes a vapor generation unit serving as an atomizer. The vapor generation unit includes a heater for heating a liquid to generate vapor. The heater includes a wick (liquid-retaining component), which is a rod-shaped liquid transport element, and a heater element, which is a wire extending in the longitudinal direction of the wick. The heater element is wound in the form of a coil around the rod-shaped wick. The heater element heats a liquid to generate vapor.

CITATION LIST

Patent Literature

PTL 1: Japanese Unexamined Patent Application Publication (Translation of PCT Application) No. 2016-511008

SUMMARY OF INVENTION

Technical Problem

With regard to PTL 1, winding the coil-shaped heater around the rod-shaped wick is a difficult task to automate. Even if the task can be automated, the task requires an apparatus that performs complex operations. This may lead to reduced productivity in producing the heater and the vapor generation unit. Further, PTL 1 does not give particular consideration as to how to produce the vapor generation unit including the heater. Therefore, challenges still exist to improve the reliability and productivity in producing the vapor generation unit, without compromising the performance of the vapor generation unit required for the non-combustible flavor inhaler.

The present invention has been made in view of the above-mentioned problem, and accordingly it is an object of the present invention to provide a method for producing a vapor generation unit for a non-combustible flavor inhaler, the method allowing for improved reliability and productivity in producing the vapor generation unit.

Solution to Problem

To attain the above-mentioned object, the present invention provides a method for producing a vapor generation unit for a non-combustible flavor inhaler, the vapor generation unit heating a liquid to generate vapor. The vapor generation unit includes a wick that retains the liquid, a wick support onto which the wick is placed, a wick holder that, when mounted to the wick support, sandwiches the wick between the wick holder and the wick support and defines an exposed face through which the wick is exposed, and a heater that, when mounted to the wick support, allows a heater element to come into contact with the exposed face. The method includes a support feeding step of feeding the wick support to a production line for the vapor generation unit, a wick feeding step of, after the support feeding step, feeding the wick toward the wick support to place the wick onto the wick support, a holder feeding step of, after the wick feeding step, feeding the wick holder toward the wick support to mount the wick holder to the wick support, and a heater feeding step of, after the holder feeding step, feeding the heater toward the wick holder to mount the heater to the wick support.

Advantageous Effects of Invention

The method according to the present invention for producing a vapor generation unit for a non-combustible flavor inhaler makes it possible to improve the reliability and productivity in producing the vapor generation unit.

DESCRIPTION OF EMBODIMENTS

With reference to the drawings, the following describes a method according to an embodiment of the present invention for producing a vapor generation unit (to be also abbreviated as "VGU" hereinafter) 1 for use in a non-combustible flavor inhaler.

Figure 1:
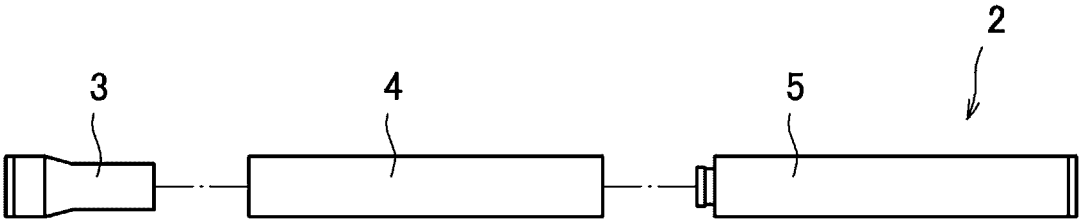
FIG. 1 is a side view of a non-combustible flavor inhaler disassembled into individual units.
Figure 2:
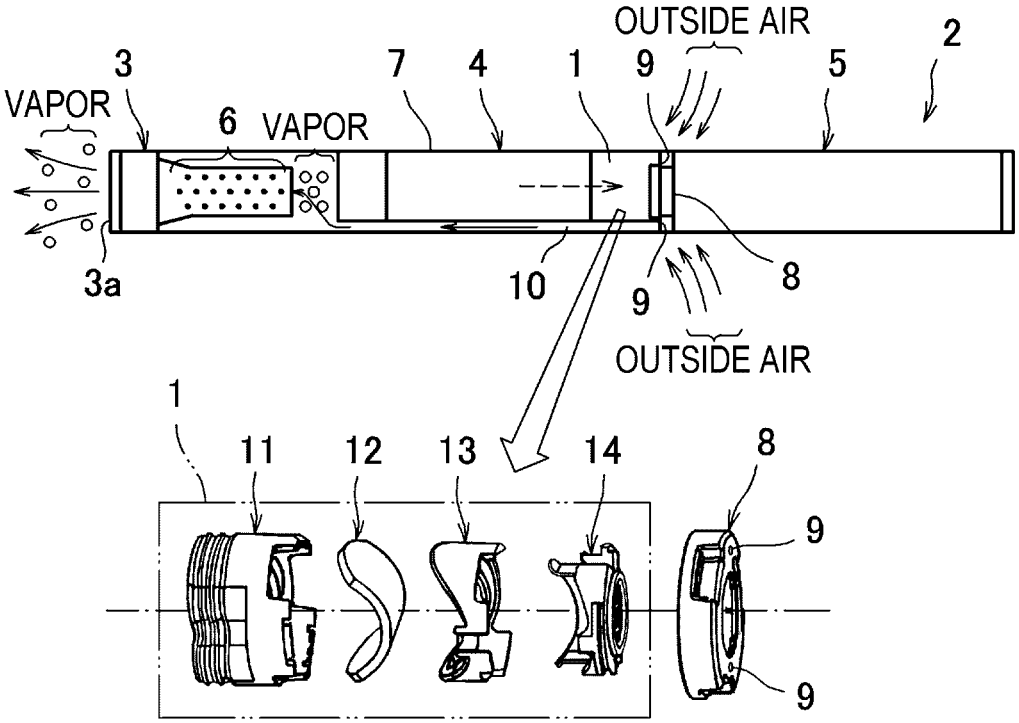
FIG. 2 illustrates the functions of individual units of the non-combustible flavor inhaler, and depicts a vapor generation unit in exploded view.

FIG. 1 is a side view of a non-combustible flavor inhaler 2 (to be also referred to simply as "inhaler" hereinafter) including the VGU 1, with the inhaler 2 disassembled into individual units. FIG. 2 illustrates the functions of individual units of the inhaler 2, and depicts the VGU 1 in exploded view.

The inhaler 2 includes a capsule unit 3, an atomizer unit 4, and a battery unit 5 that are connected in the axial direction of the inhaler 2. A flavor source 6 is disposed in the capsule unit 3. The VGU 1, and a tank 7, which stores a liquid containing an aerosol-forming material, are disposed in the atomizer unit 4. The battery unit 5 is connected with the atomizer unit 4 to supply power to the VGU 1.

The liquid in the tank 7 is introduced to the VGU 1 as indicated by a broken arrow in FIG. 2. The VGU 1 heats the introduced liquid to generate vapor. As the vapor passes through a flow channel 10 described later, the vapor is cooled, and an aerosol is generated. The liquid stored in the tank contains an aerosol-forming material, for example, glycerol or propylene glycol.

The flavor source 6 is at least one of, for example, the following materials: shredded tobacco; a body obtained by forming a tobacco material into granulated or sheet form; a plant other than tobacco; and some other flavoring. The flavor source 6 is accommodated in the capsule unit 3 in a leak-proof manner. In some embodiments, the liquid in the tank 7 may contain nicotine. In some embodiments, the capsule unit 3 may not contain the flavor source 6, in which case the capsule unit 3 is used simply as a suction component (e.g., a mouthpiece).

A cap 8 of the VGU 1 is disposed in a portion of the atomizer unit 4 near the battery unit 5. The cap 8 has at least one air vent 9 through which outside air is introduced into the atomizer unit 4. When the user sucks on a suction end 3*a* of the capsule unit 3, outside air is introduced into the atomizer unit 4 through, for example, two air vents 9 as indicated by solid arrows in FIG. 2.

The flow channel 10 is defined in the interior of the atomizer unit 4, for example, in a location beside the tank 7. Vapor generated in the VGU 1 is cooled to form an aerosol as the vapor passes through the flow channel 10 together with the outside air introduced through each air vent 9. The aerosol then passes through the flavor source 6 in the capsule unit 3 for delivery to the user's mouth. The user inhales the aerosol that has passed through the flavor source 6 to thereby ingest components contained in the flavor source 6.

As illustrated in the exploded perspective view of FIG. 2, the VGU 1 includes the following components arranged in the order stated below as viewed from the tank 7: a wick support 11; a wick 12, which is placed onto the wick support 11; a wick holder 13, which is mounted to the wick support 11; and a heater 14, which is mounted to the wick support 11. The cap 8 covers the VGU 1 at the location of the heater 14, and defines an end portion of the atomizer unit 4.

Figure 3:
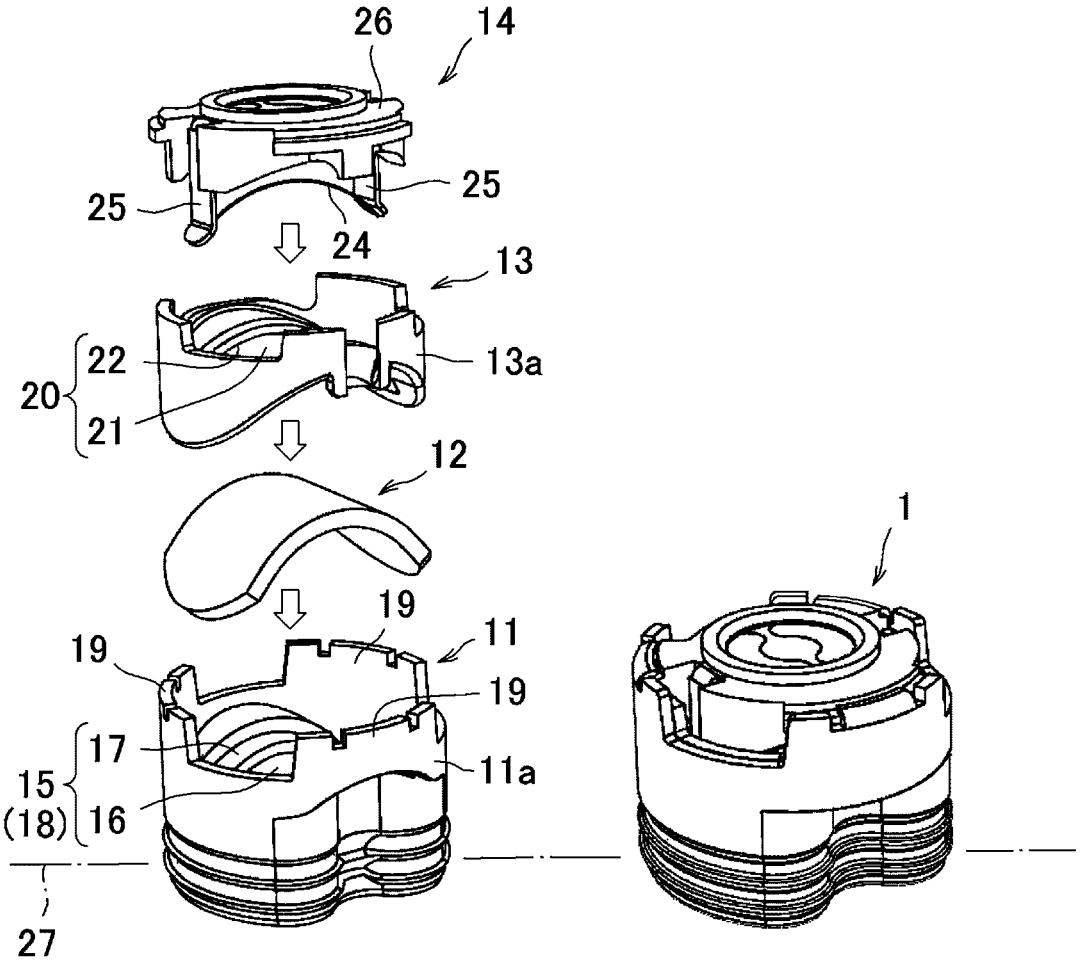
FIG. 3 is a perspective view of the vapor generation unit, illustrating the order and direction of assembly of individual components of the vapor generation unit.

FIG. 3 is a perspective view of the VGU 1, illustrating the order and direction of assembly of the components 11, 12, 13, and 14 of the VGU 1. The wick support 11 is made of, for example, resin, and has a tubular peripheral wall 11*a*. A support part 15 is disposed inside the peripheral wall 11*a*. The wick 12 bent in a curved shape is placed onto the support part 15.

In the embodiment, the support part 15 has a curved shape that is convex upward as viewed in FIG. 3. The support part 15 has a liquid introduction opening 16, and a support face 17. The liquid introduction opening 16 defines a portion of a flaw channel through which the liquid in the tank 7 is introduced to the wick 12 by capillary action or other phenomena. The support face 17 is an annular curved face provided at the opening edge of the liquid introduction opening 16. The support part 15 is formed in a recess 18 deep enough to accommodate the wick 12.

The peripheral wall 11*a* of the wick support 11 has a shape and an inner diameter that allow insertion and mounting of the wick holder 13. The peripheral wall 11*a* has plural, for example, three crimping claws 19 provided at its upper end. In mounting the heater 14, the crimping claws 19 are bent to secure the heater 14 in place.

The wick 12 is a liquid-retaining component that has sufficient flexibility to allow its shaping and has sufficient infiltration capability to allow liquid retention. The wick 12 is made of a fibrous material, examples of which include a glass fiber and cotton. The wick 12 is in the form of a rectangular plate that is curved along the support face 17.

The wick holder 13 is made of, for example, resin, and has a tubular peripheral wall 13*a*. A holder part 20 is disposed inside the peripheral wall 13*a*. When the wick holder 13 is mounted to the wick support 11, the holder part 20 sandwiches the wick 12 together with the support part 15.

As with the support part 15, the holder part 20 has a curved shape that is convex upward. The holder part 20 has an exposed opening 21, and a holder face 22.

When the wick holder 13 is mounted to the wick support 11, the exposed opening 21 defines an exposed face 23 described later, through which the wick 12 is exposed. The holder face 22 is an annular curved face provided at the opening edge of the exposed opening 21. The holder face 22 is oriented downward as viewed in FIG. 3, and faces the support face 17 in mounting the wick holder 13. When the wick holder 13 is mounted to the wick support 11, the outer peripheral edge of the wick 12 is sandwiched between the support face 17 and the holder face 22.

The heater 14 includes: a heater element 24, which is, for example, a single wire; a pair of electrodes 25 for, upon supply of power from the battery unit 5, causing the heater element 24 to generate heat; and a base 26 made of, for example, resin and to which the pair of electrodes 25 are secured.

The VGU 1 configured as described above is produced by a method that first feeds the wick support 11 to a production line 27 (support feeding step).

Subsequently, as indicated by an arrow in FIG. 3, for example, the wick 12 is fed toward the wick support 11 from above and placed onto the wick support 11 (wick feeding step). Then, as indicated by an arrow in FIG. 3, for example, the wick holder 13 is fed toward the wick support 11 from above and mounted to the wick support 11 (holder feeding step). Then, as indicated by an arrow in FIG. 3, for example, the heater 14 is fed toward the wick holder 13 from above and mounted to the wick support 11 (heater feeding step).

As described above, the method for producing the VGU 1 according to the embodiment involves first feeding the wick support 11, and then sequentially feeding the other components 12, 13, and 14 toward the wick support 11 in one direction for mounting to the wick support 11.

Figure 4:
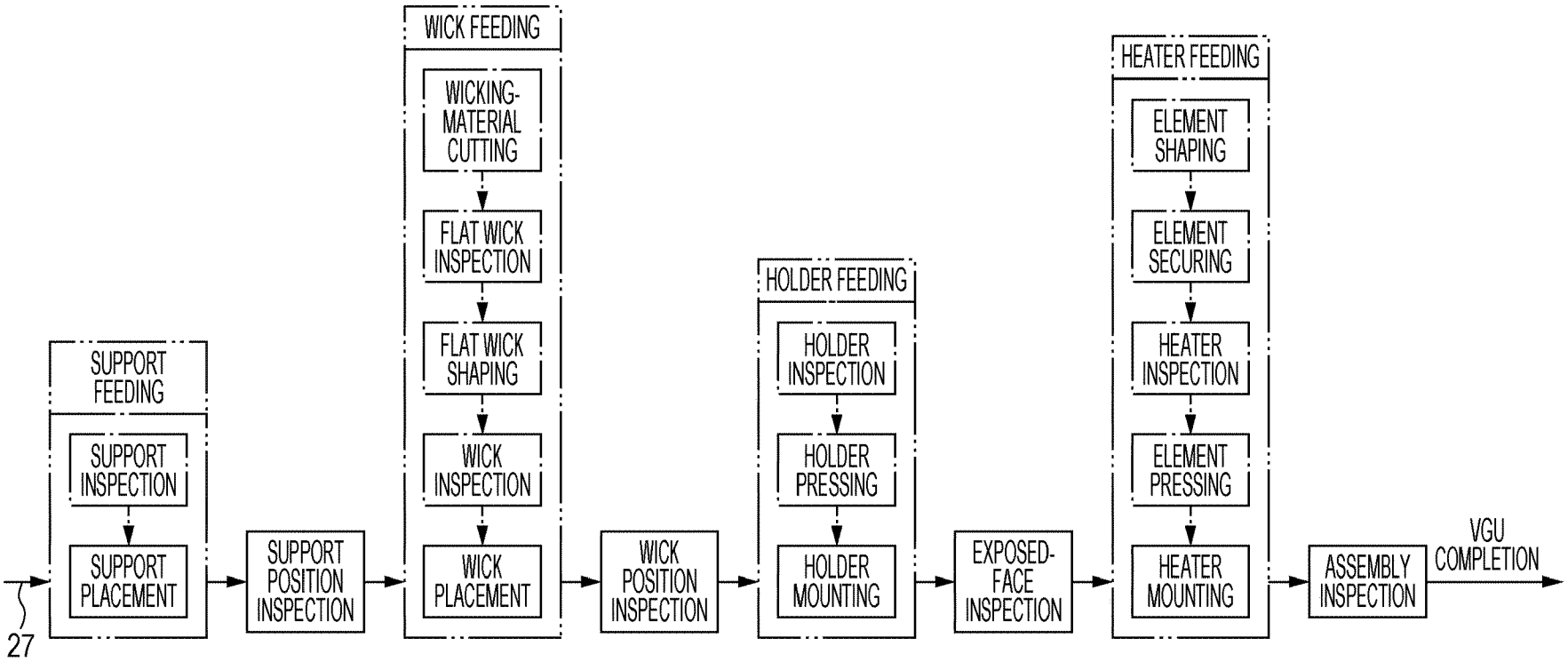
FIG. 4 is a block diagram illustrating a procedure for producing the vapor generation unit.

FIG. 4 is a block diagram illustrating a procedure for producing the VGU 1. Reference is now made to FIG. 4 and the subsequent figures to provide a detailed description of a procedure and processes for producing the VGU 1.

<Support Feeding Step>

[Support Inspection Process]

The profile of the wick support 11 is inspected. Specifically, this inspection inspects features of the wick support 11 such as the external shape, dimensions, and internal structure.

In particular, it is inspected whether the peripheral wall 11*a* of the wick support 11 is dimensioned to have an inner diameter that allows mounting of the wick holder 13, and whether the shape, position, dimensions, and other features of the support part 15 and the crimping claws 19 are appropriate. This involves a process such as removing any non-conforming part from the production line 27. The profile inspection may employ various inspection means such as camera-based image recognition, laser scanning, and X-ray inspection. The same is true for other inspections described later.

[Support Placement Process]

The wick support 11 that has undergone inspection is placed onto the production line 27. The wick support 11 may be produced as part of the procedure for producing the VGU 1, or may be produced separately from the procedure for producing the VGU 1 and then fed to the production line 27. Regardless of the subsequent description, the same applies to the other components 12, 13, and 14.

In one alternative example, the wick support 11 may be transported along the production line 27, and in various sections of the production line 27 at which the wick support 11 arrives, the other components 12, 13, and 14 may be fed as needed for mounting to the wick support 11. In another alternative example, mechanisms, apparatuses, or other pieces of equipment for performing various steps may move relative to the wick support 11 placed on the production line 27 to thereby feed the other components 12, 13, and 14 toward the wick support 11 for mounting to the wick support 11.

<Support-Position Inspection Step>

The wick support 11 fed to the production line 27 is inspected for proper positioning. Specifically, this inspection inspects the wick support 11 for misalignment or proper orientation with respect to the production line 27. Improper positioning of the wick support 11 at this point may lead to problems in the subsequent steps, and thus a suitable correction is made at this point.

<Wick Feeding Step>

[Wicking-Material Cutting Process]

Figure 5:
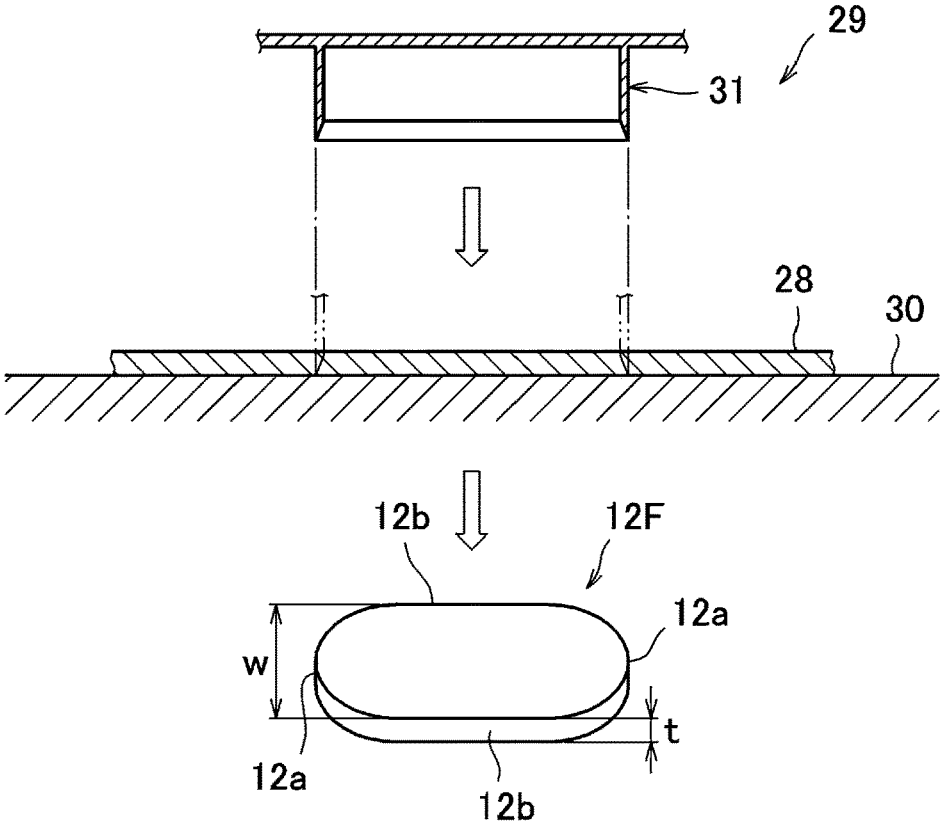
FIG. 5 illustrates a wick cutting process in a wick feeding step.

FIG. 5 illustrates a wicking-material cutting process. In this process, a wicking material 28, which is in sheet or roll form and from which the wick 12 is made, is cut into a size that fits the support part 15 of the wick support 11.

A cutting mechanism 29 used for this process includes a table 30 on which to place the wicking material 28, and a die 31 that can be raised and lowered relative to the table 30. By lowering the die 31 as indicated by an arrow toward the wicking material 28 placed on the table 30, a rectangular flat wick 12F is formed as the flat wick 12F is punched out of the wicking material 28. The flat wick 12F is in the form of a rectangular flat plate having a thickness t, and a width W in the lateral direction. The flat wick 12F has a pair of arcuate end portions 12*a* extended in the lateral direction, and the other pair of straight end portions 12*b*.

The wicking-material cutting process may employ other cutting means. In one example, a large number of flat wicks 12F may be punched and cut out of the wicking material 28 at once. In another example, the wicking material 28 may be passed in between two or more roller components, and the flat wick 12F may be cut out with a rotary die. In another example, the flat wick 12F may be cut out with a laser cutter or a water cutter.

[Flat-Wick Inspection Process]

The profile of the flat wick 12F is inspected. Specifically, this inspection inspects features of the flat wick 12F such as the external shape, dimensions, wall thickness, and surface condition. This involves a process such as removing any non-conforming part from the production line 27.

[Flat-Wick Shaping Process]

Figure 6:
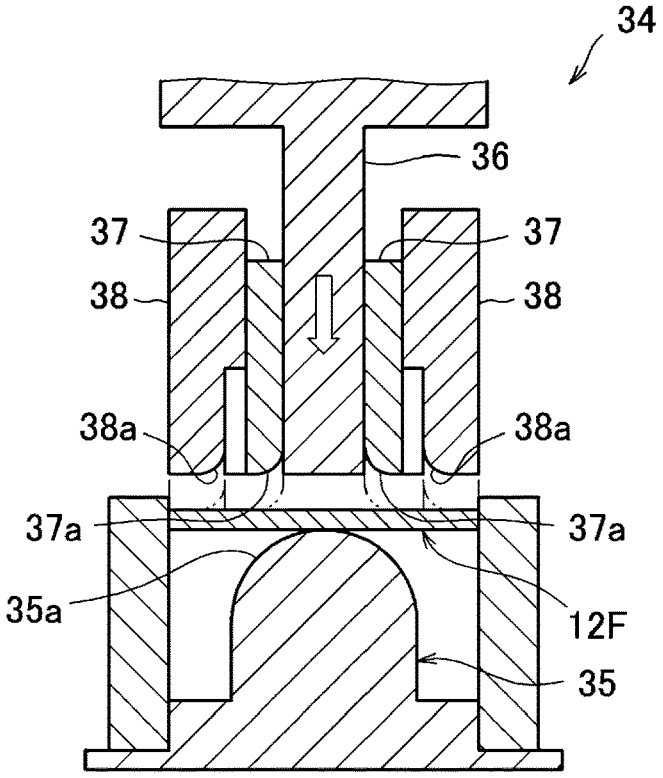
FIG. 6 illustrates a wick shaping process in the wick feeding step.

FIG. 6 illustrates an embodiment of a wick shaping process. This process involves shaping the wicking material 28 cut in the wicking-material cutting process, that is, the flat wick 12F to impart a curved face 32 described later that has a curvature conforming to the support face 17 of the wick support 11.

A shaping mechanism 34 used for this process includes the following components: a guide 35 on which to place the flat wick 12F; a center pusher 36 that faces the guide 35; a pair of inner pushers 37 located radially outward of and adjacent to the center pusher 36; and a pair of outer pushers 38 located radially outward of and adjacent to the pair of inner pushers 37.

The guide 35 has a guide face 35*a* curved to allow formation of the curved face 32 of the wick 12. The pushers 36, 37, and 38 can be individually raised and lowered to cause the flat wick 12F to curve along its entire width W into conformity with the guide face 35*a*. The pair of inner pushers 37 each have an arcuate face 37*a* provided at a corner of the distal end portion near the center pusher 36. The pair of outer pushers 38 each have an arcuate face 38*a* provided at a corner of the distal end portion near the center pusher 36.

Figure 7:
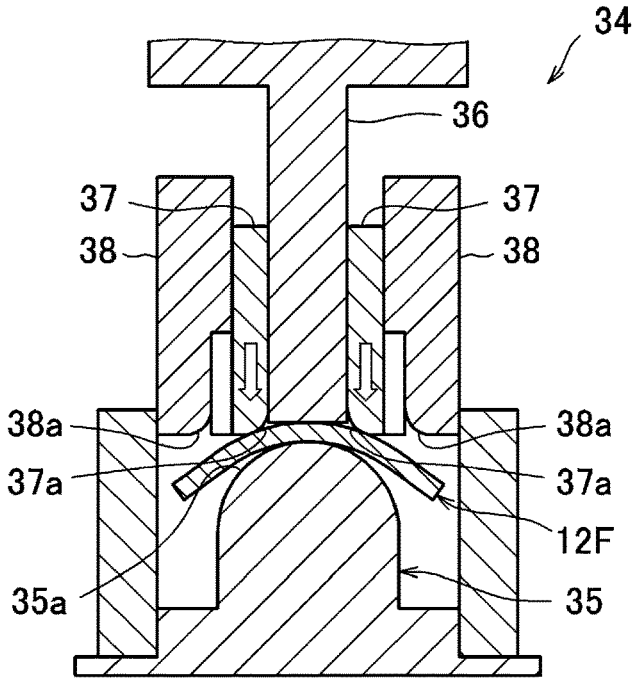
FIG. 7 illustrates first shaping in the wick shaping process.
Figure 8:
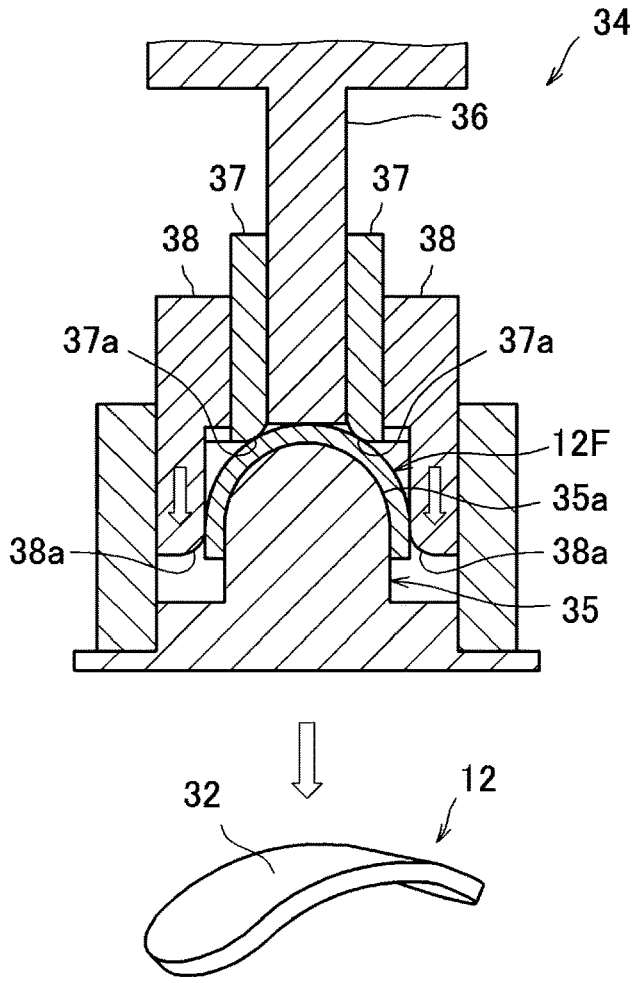
FIG. 8 illustrates second shaping in the wick shaping process.

Reference is now made to FIGS. 6 to 8 to describe how the shaping mechanism 34 operates. First, the pushers 36, 37, and 38 are lowered as indicated by an arrow toward the flat wick 12F so that, as indicated by broken lines in FIG. 6, the central portion of the flat wick 12F as viewed in FIG. 6 is sandwiched between the center pusher 36 and the guide 35 to thereby hold the flat wick 12F against misalignment.

Subsequently, as illustrated in FIG. 7, first shaping is applied to the flat wick 12F by further lowering the pair of inner pushers 37 as indicated by arrows to cause both side portions of the flat wick 12F near the center of the flat wick 12F to curve slightly.

Then, as illustrated in FIG. 8, second shaping is applied to the flat wick 12F by further lowering the pair of outer pushers 38 as indicated by arrows to cause both side portions of the flat wick 12F to curve into conformity with the guide face 35*a*.

The wick 12 taken out from the shaping mechanism 34 after the second shaping is biased to have the curved face 32 with a curvature that conforms to the support face 17 of the wick support 11. In this way, the shaping mechanism 34 performs two stages of shaping including preliminary first shaping applied by the inner pushers 37, and second shaping applied by the pushers 38. This makes it possible to precisely control the location where the flat wick 12F contacts the guide 35, thus allowing for more precise shaping of the wick 12.

The presence of the arcuate faces 37*a* and 38*a* helps to reduce the friction upon contact of the inner pushers 37 and the outer pushers 38 with the flat wick 12F, thus reducing the force exerted on the surface of the flat wick 12F in the direction of tension. This allows for precise shaping to impart a smooth curved face 32 to the wick 12 that conforms to the support face 17 and the holder face 22, while reducing tearing, cracking, or other damage to the wick 12.

The flat-wick shaping process may employ other shaping means. In one example, the flat wick 12F may be placed onto the support part 15 of the wick support 11, and directly pressed against the support face 17 for shaping. In another example, the inner pushers 37 and the outer pushers 38 may be roller components, and the flat wick 12F may be shaped by these roller components into conformity with the guide face 35*a*. In another example, the flat wick 12F may be shaped by a method such as blasting of compressed air or vacuuming.

[Wick Inspection Process]

The profile of the wick 12 is inspected. Specifically, this inspection inspects features of the wick 12 such as the dimensions including the width W, surface condition, the radius of curvature of the curved face 32, the thickness t, and the length of the arc line of the curved face 32. This involves a process such as removing any non-conforming part from the production line 27.

[Wick Placement Process]

Figure 9:
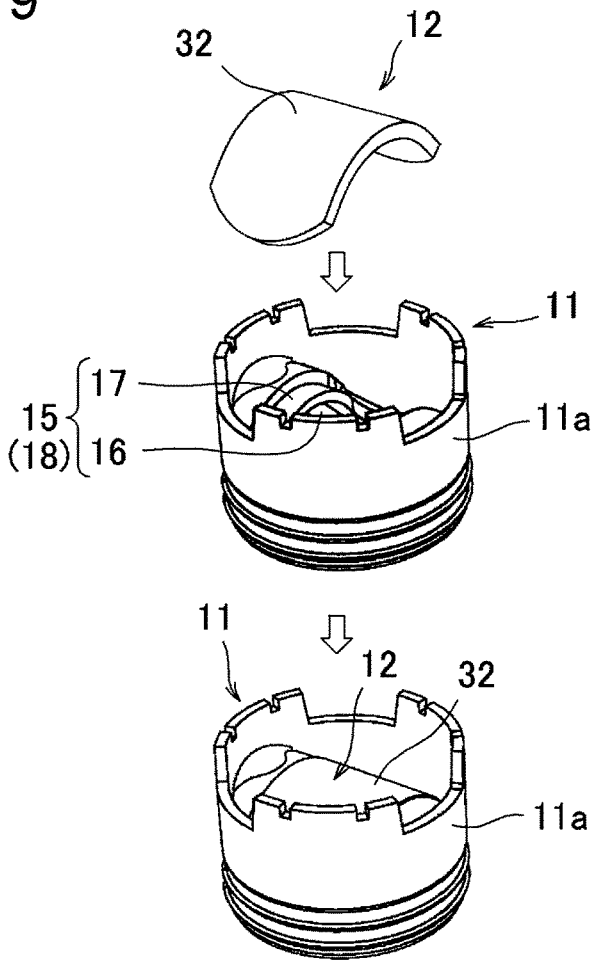
FIG. 9 illustrates a wick placement process.

FIG. 9 illustrates a wick placement process. In this process, the wick 12 that has undergone inspection is placed onto the support part 15 of the wick support 11 from above. As a result, the liquid introduction opening 16 is covered by the wick 12, and the outer peripheral edge of the wick 12 is positioned on the support face 17.

<Wick-Position Inspection Step>

Figure 10:
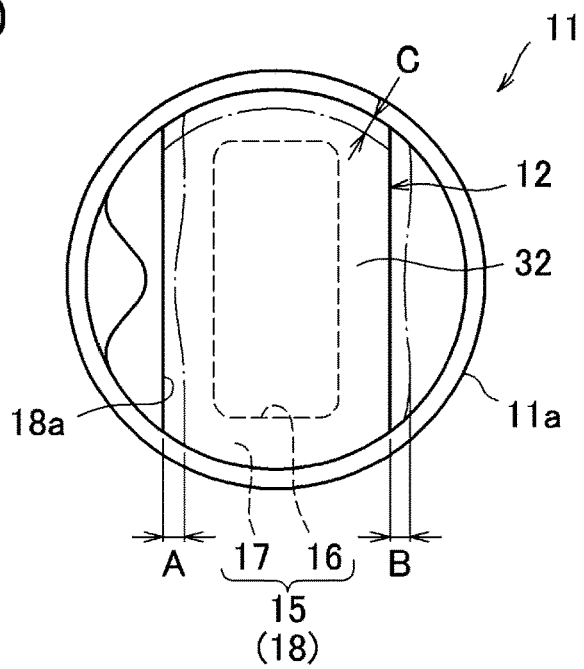
FIG. 10 illustrates a wick-position inspection step.

FIG. 10 illustrates a wick-position inspection step. This step inspects the position of the wick 12 placed on the wick support 11. Specifically, this step inspects for misalignment of the outer peripheral edge of the wick 12 with respect to the entire periphery of an inner peripheral wall 18*a* of the recess 18. This inspection is performed to determine that, even if the outer peripheral edge of the wick 12 is slightly misaligned as indicated by alternate long and short dash lines in FIG. 10, the outer peripheral edge of the wick 12 is positioned within, for example, tolerances A, B, and C, and that no gap is present between the wick 12 and the liquid introduction opening 16 (liquid-introduction-opening inspection).

It is also inspected whether the outer peripheral edge of the wick 12 is aligned with the support face 17 (support-face inspection). If it is determined as a result of the above-mentioned inspections that the misalignment of the wick 12 exceeds the tolerances A, B, and C, and that a gap is present between the wick 12 and the liquid introduction opening 16 or that the outer peripheral edge of the wick 12 is not in alignment with the support face 17, this is indicative of potential leakage of liquid from areas where the wick 12 is misaligned. Therefore, such a non-conforming part is removed from the production line 27 as appropriate. The wick-position inspection step may also include detecting the absence of the wick 12.

<Holder Feeding Step>

[Holder Inspection Process]

Figure 11:
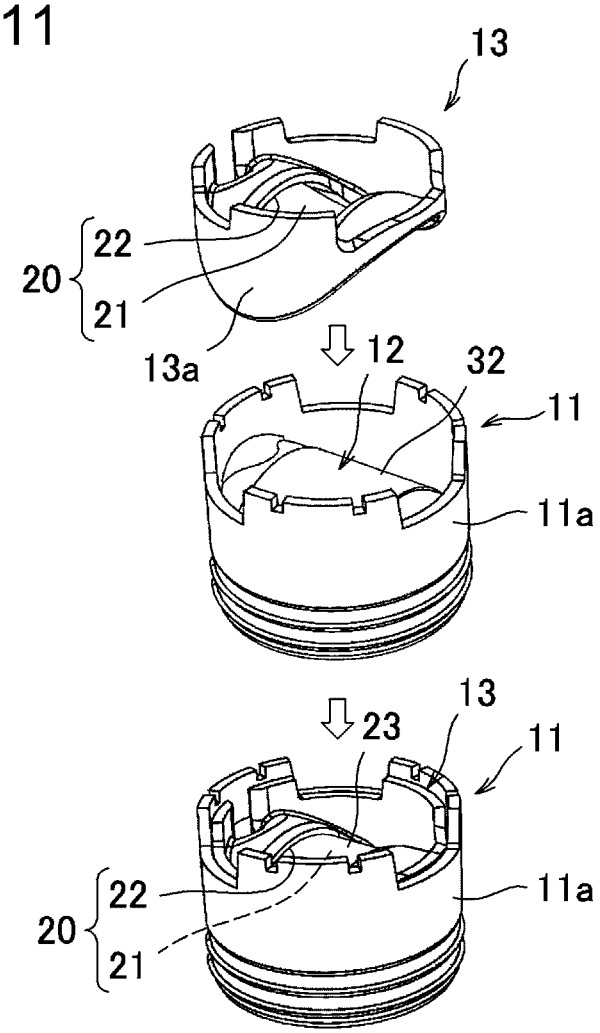
FIG. 11 illustrates a holder feeding step.

FIG. 11 illustrates a holder feeding step. This process inspects the profile of the wick holder 13. Specifically, this inspection inspects features of the wick holder 13 such as the external shape, dimensions, and internal structure. In particular, this inspection inspects whether the peripheral wall 13*a* of the wick holder 13 is dimensioned to have an outer diameter that allows mounting to the wick support 11, and whether the shape, position, dimensions, and other features of the holder part 20 are appropriate, and involves a process such as removing any non-conforming part from the production line 27.

[Holder Pressing Process]

The wick holder 13 that has undergone inspection is fed toward the wick support 11, and inserted inside the peripheral wall 11*a* of the wick support 11. At this time, the wick holder 13 sandwiches the wick 12 between the wick holder 13 and the wick support 11, and allows the wick 12 to be exposed through the exposed opening 21 to define the exposed face 23.

To define the exposed face 23, the holder face 22 is pressed against the support face 17 of the wick support 11 with a predetermined holder-pressing force. The holder-pressing force has a magnitude sufficient to prevent the liquid retained in the wick 12 from leaking through the outer peripheral edge of the wick 12 sandwiched between the support face 17 and the holder face 22. This ensures that in the VGU 1, the liquid in the tank 7 does not leak out through the outer peripheral edge of the wick 12, while allowing the liquid to be efficiently introduced to the exposed face 23 through the liquid introduction opening 16.

[Holder Mounting Process]

After undergoing the holder pressing process, the wick holder 13 is mounted to the wick support 11, which causes the exposed face 23 to be defined.

<Exposed-Face Inspection Step>

Figure 12:
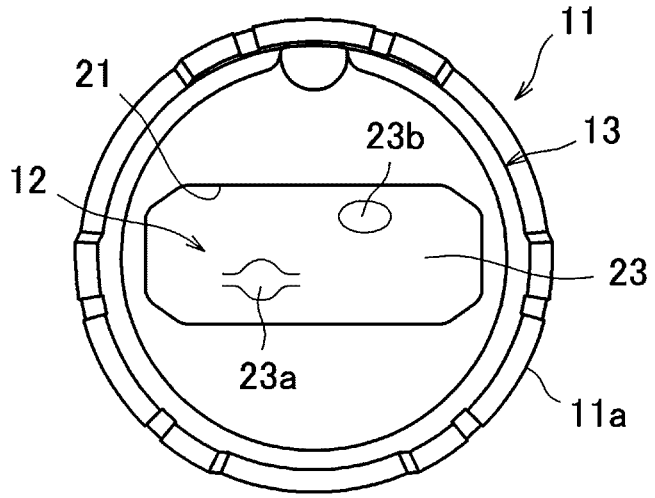
FIG. 12 illustrates a surface inspection process in an exposed-face inspection step.
Figure 13:
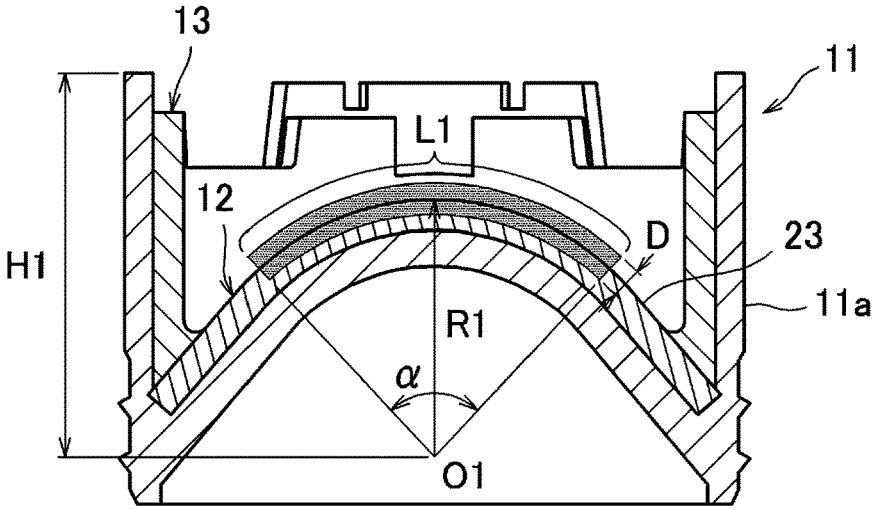
FIG. 13 illustrates a curvature-radius inspection process and other processes in the exposed-face inspection step.

FIGS. 12 and 13 illustrate an exposed-face inspection step. This step inspects the profile of the exposed face 23 of the wick 12.

Specifically, as illustrated in FIG. 12, the exposed face 23 is imaged from above with a camera or other device for image recognition of the condition of the exposed face 23, and it is inspected whether the exposed face 23 is free of a stepped portion 23*a* or a hollow 23*b* (exposed-face inspection). The exposed-face inspection step may employ other inspection means. For example, it is possible to measure the airflow resistance through the wick 12 to thereby inspect the presence of holes or depressions on the exposed face 23, the presence of differences in fibrous material density or other non-uniformities, or the position of the exposed face 23.

Further, as illustrated in FIG. 13, the exposed face 23 is inspected from the side by use of X-rays or other methods to inspect whether the exposed face 23 has a radius of curvature R1 that falls within the tolerance D (exposed-face curvature inspection). The tolerance D is set by taking into account an error allowed for a radius of curvature R2 of the heater element 24 described later, an error allowed for the assembly of the VGU 1, or other factors.

The exposed face 23 is inspected within a predetermined range of an arc line length L1 depicted shaded in FIG. 13 and extending over a predetermined angle α with reference to the center O1 of the radius of curvature R1. This inspection range includes at least a region with which the heat-generating region of the heater element 24 comes into contact after the assembly of the VGU 1 is completed.

Further, as illustrated in FIG. 13, it is inspected whether a height H1 from the center O1 of the radius of curvature R1 to the upper end of the peripheral wall 11*a* of the wick support 11 is appropriate (exposed-face position inspection). This is because proper positioning of the exposed face 23 in the wick support 11 affects the assembly error in the completed VGU 1.

The profile of the exposed face 23 of the wick 12 is inspected through the above-mentioned inspections. This helps to ensure that, in the completed VGU 1, leakage of liquid through the exposed face 23 is prevented, and the entire heat-generating region of the heater element 24 is brought into contact with the exposed face 23 with an appropriate pressing force. This allows the liquid infiltrating the wick 12 to be efficiently volatized by the heater element 24 while preventing, for example, a break in the heater element 24 due to overheating.

<Heater Feeding Step>

[Element Shaping Process]

Figure 14:
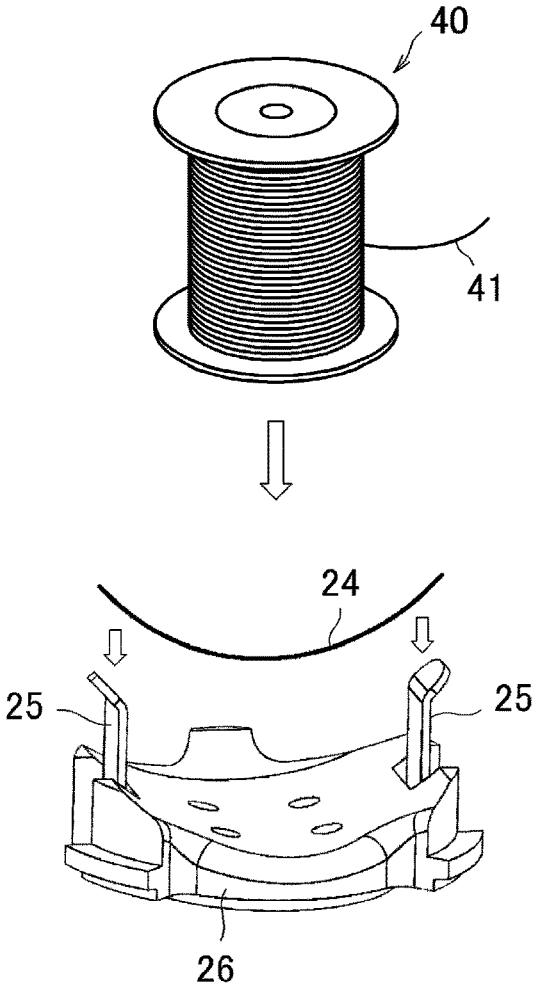
FIG. 14 illustrates a heater feeding step.
Figure 15:
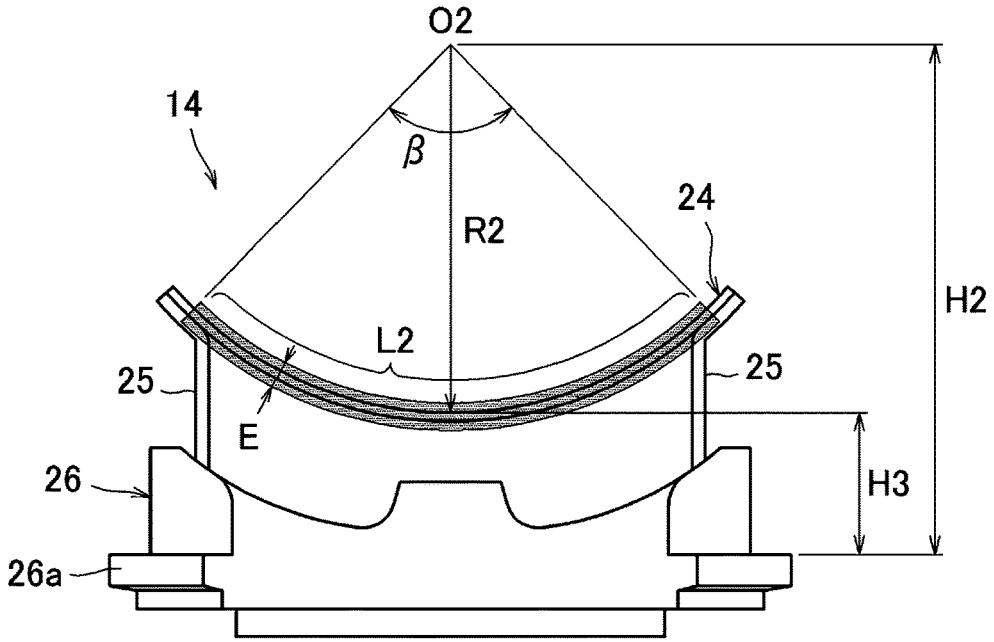
FIG. 15 illustrates a heater inspection process in the heater feeding step.

FIGS. 14 and 15 illustrate a heater feeding step. As illustrated in FIG. 14, to produce the heater 14, a wire 41 is drawn out and cut from a wire coil 40, and shaped into a curved heater element 24 by a method such as pressing the wire 41 against a shaping guide (not illustrated).

The element shaping process may employ other shaping means. For example, the heater element 24 with a curved shape may be formed by shaping such as shaping by punching with a die, shaping by use of a rotary die with the heater element 24 passed between two or more die-equipped circular roller components, or shaping by photoetching.

[Element Securing Process]

As indicated by arrows in FIG. 14, the heater element 24 with a curved shape is fed in an orientation such that the heater element 24 is convex toward the base 26, and opposite ends of the heater element 24 are brought into contact with the pair of electrodes 25 and secured onto the pair of electrodes 25 by resistance welding. The heater element 24 may be secured onto the electrodes 25 by any securing means that ensures the reliability of securing strength as well as extremely small electrical resistance, such as laser welding, ultrasonic welding, or bonding. Alternatively, the heater element 24 may be secured by crimping, soldering, or other methods.

[Heater Inspection Process]

The profile of the heater element 24 secured on the pair of electrodes 25 is inspected. Specifically, this inspection inspects, through camera-based image recognition or other methods, whether the radius of curvature R2 of the heater element 24 falls within a tolerance E (element-curvature inspection) as illustrated in FIG. 15. The tolerance E is set by taking into account an error allowed for the radius of curvature R1 of the exposed face 23, an error allowed for the assembly of the VGU 1, or other factors.

The heater element 24 is inspected within a predetermined range depicted shaded in FIG. 15 and extending over a predetermined angle β with reference to the center O2 of the radius of curvature R2. This inspection range includes at least the heat-generating region of the heater element 24.

As illustrated in FIG. 15, it is also inspected whether the heat-generating region of the heater element 24 has a predetermined arc line length L2 (element-length inspection). Since the arc line length L2 determines the electrical resistance of the heater element 24, the arc line length L2 needs to be matched to a predetermined length suitable for the heating performance required for the VGU 1.

It is also inspected whether, for example, a height H2, which is the height from the center O2 of the radius of curvature R2 to a basal portion 26*a* of the base 26, and a height H3, which is the shortest height from the basal portion 26*a* to the heater element 24, is appropriate (element-position inspection). This is because proper positioning of the heater element 24 in the heater 14 affects the assembly error in the completed VGU 1.

Through image recognition, the state of securing of the heater element 24 on the pair of electrodes 25 is also inspected (securing inspection). Further, the electrical resistance of the heater element 24 upon supply of power to the pair of electrodes 25 is inspected (resistance inspection). The profile of the heater element 24 secured on the pair of electrodes 25 is thus inspected through the above-mentioned inspections.

This helps to further ensure that in the completed VGU 1, the entire heat-generating region of the heater element 24 contacts the exposed face 23 with an appropriate pressing force. This allows the liquid infiltrating the wick 12 to be efficiently volatized by the heater element 24 that is generating heat, while preventing, for example, a break in the heater element 24 due to overheating.

[Heater Mounting Process]

As is apparent from FIG. 3, the heater 14 that has undergone inspection is fed toward the wick holder 13 from above with the heater element 24 facing the exposed face 23, and is accommodated into the wick holder 13 with the base 26 facing up.

Figure 16:
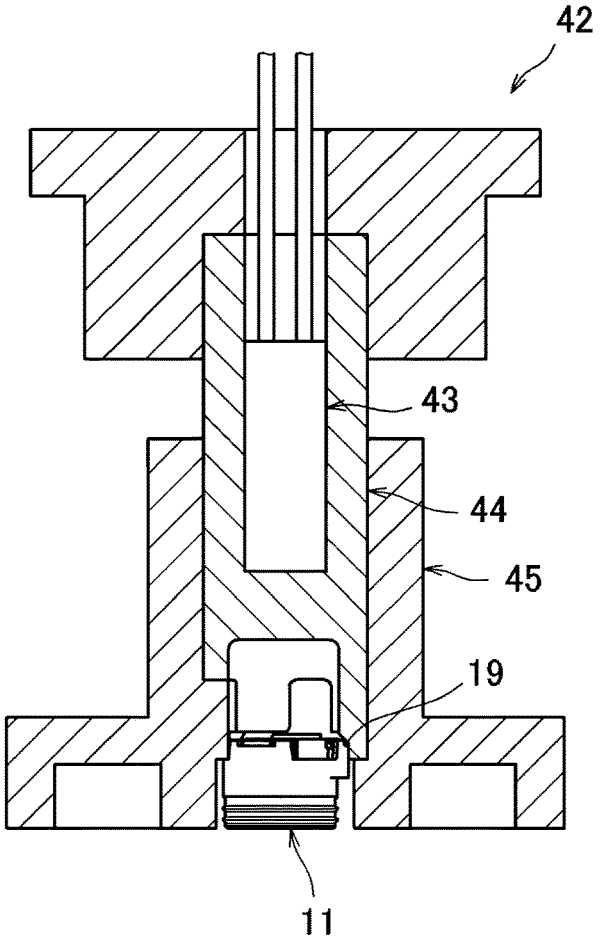
FIG. 16 is cross-sectional view of a heater mounting mechanism that performs a heater mounting process.

FIG. 16 is cross-sectional view of a heater mounting mechanism 42 that performs a heater mounting process. The heater mounting mechanism 42 includes a shaping pusher 44 made of metal with a heater 43 built therein, and a support component 45 that supports the shaping pusher 44 in a manner that allows the shaping pusher 44 to be raised and lowered. The wick support 11 on which the heater 14 has been placed is placed below the shaping pusher 44, and positioned and secured in place by the support component 45. The shaping pusher 44 is heated as power is supplied to the heater 43. Then, the support component 45 causes the shaping pusher 44 to be lowered.

Figure 17:
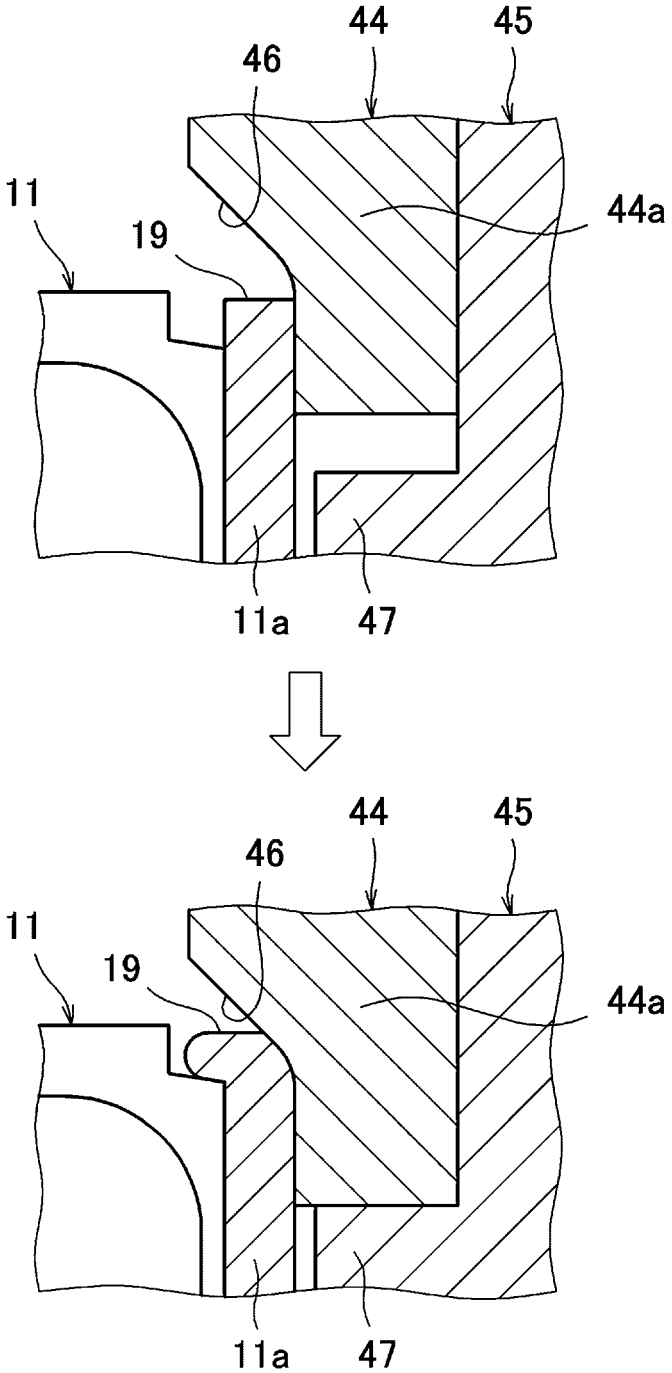
FIG. 17 is an enlarged illustration of the vicinity of a crimping claw of a wick support.

FIG. 17 is an enlarged view of the vicinity of the crimping claw 19 of the wick support 11 illustrated in FIG. 16. The shaping pusher 44 has inclined pressing faces 46 in a lower portion of a peripheral wall 44*a*. The pressing faces 46 are provided at locations corresponding to the three crimping claws 19 of the wick support 11. The support component 45 has a stopper part 47 to restrict the lowering of the shaping pusher 44. As the shaping pusher 44 is lowered, the three pressing faces 46 corresponding to the three crimping claws 19 each press the corresponding crimping claw 19 while causing the crimping claw 19 to soften under high temperature. This causes the crimping claw 19 to bend toward the center of the wick support 11.

Figure 18:
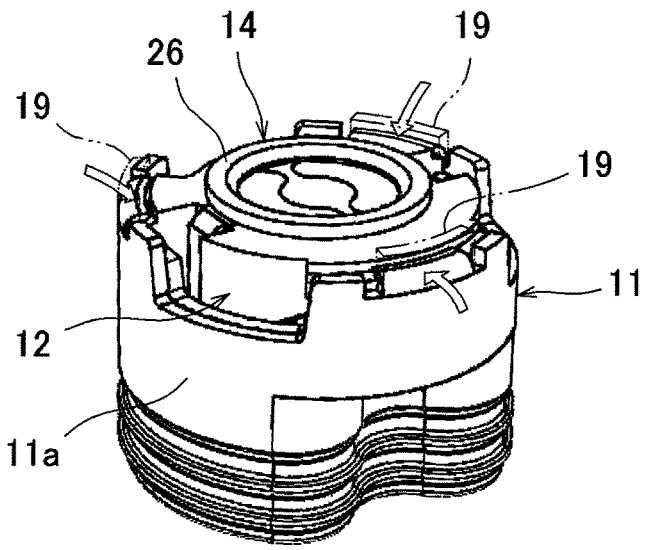
FIG. 18 is a perspective view of the wick support, illustrating crimping of crimping claws.

FIG. 18 is a perspective view of the wick support 11, illustrating crimping of the crimping claws 19. As the crimping claws 19 are bent as indicated by arrows in FIG. 18, the base 26 of the heater 14 is secured against detachment from the wick support 11, and the heater 14 is mounted to the wick support 11 to complete the assembly of the VGU 1.

The heater mounting process may employ other mounting means. Suitable examples of such mounting means may include: a lock mechanism (e.g., a notch lock) based on engagement between the resin portions of the heater 14 and the wick support 11; bonding; fitting (e.g., interference fit or transition fit); laser welding; and ultrasonic welding. Such mounting means including crimping is also applicable to the holder mounting process described above.

[Element-Pressing Process]

In conjunction with the mounting of the heater 14 to the wick support 11 performed as described above, the heater element 24 is brought into contact with the exposed face 23 with a predetermined element-pressing force. In this regard, since the respective profiles of the wick support 11, the wick 12, the wick holder 13, the exposed face 23, and the heater element 24 secured on the pair of electrodes 25 have been inspected as described above, the shapes, dimensions, conditions, and other features of these components are appropriate at this time.

Accordingly, as the crimping claws 19 of the wick support 11 are bent in the heater mounting process mentioned above, an element-pressing force produced by the bending causes the entire heat-generating region of the heater element 24 to come into contact with the exposed face 23. Thus, there is no area where the heater element 24 does not contact the exposed face 23. This prevents, for example, a break in the heater element 24 due to overheating.

The element-pressing force is of a magnitude that ensures that a break in the heater element 24 does not occur due to contact with the exposed face 23. In other words, the element-pressing force is set so as to avoid excessive crimping by the crimping claws 19. This helps to ensure that a break does not occur in the heater element 24 in mounting the heater 14 to the wick support 11.

<Assembly Inspection Step>

This step inspects the state of assembly of the VGU 1 whose assembly is completed.

[Element-Contact Inspection Process]

This process inspects the state of contact between the exposed face 23 and the heater element 24, based on the state of assembly of the VGU 1 whose assembly is completed.

Figure 19:
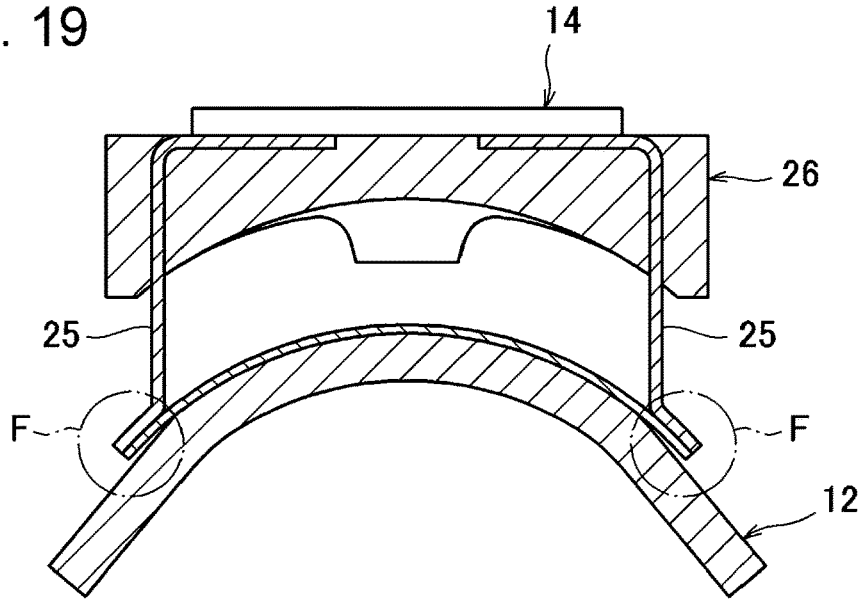
FIG. 19 illustrates poor contact of a heater element with the exposed face of a wick.

FIG. 19 illustrates poor contact of the heater element 24 with the exposed face 23 of the wick 12. In some cases, inspecting the completed VGU 1 from the side by use of X-rays or other methods may result in, for example, detection of areas where the heater element 24 is not in contact with the exposed face 23 as indicated by regions F in FIG. 19. The presence of such non-contact areas may lead to a break in the heater element 24 due to overheating. Such a VGU 1 with potential performance defects need to be identified and removed.

Figure 20:
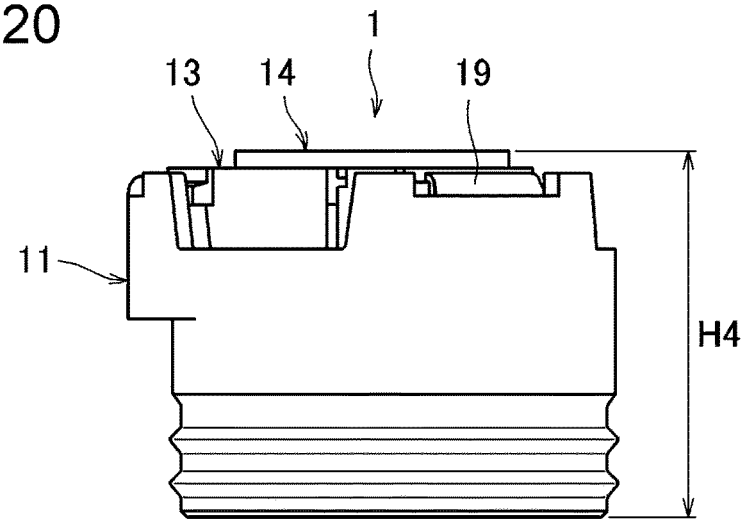
FIG. 20 illustrates an element-contact inspection process.

FIG. 20 illustrates an element-contact inspection process. This process inspects the state of contact between the heater element 24 and the wick 12 based on a height H4 of the VGU 1 in the direction in which these components contact each other, that is, the height of the completed VGU 1 (assembly error inspection). This inspection technique is employed based on the idea that, assuming that the respective profiles of the components 11, 12, 13, and 14 of the VGU 1 have been individually determined as conforming through the corresponding inspections, then non-contact of the heater element 24 with the exposed face 23 is likely to be due to an assembly error in the VGU 1.

Figure 21:
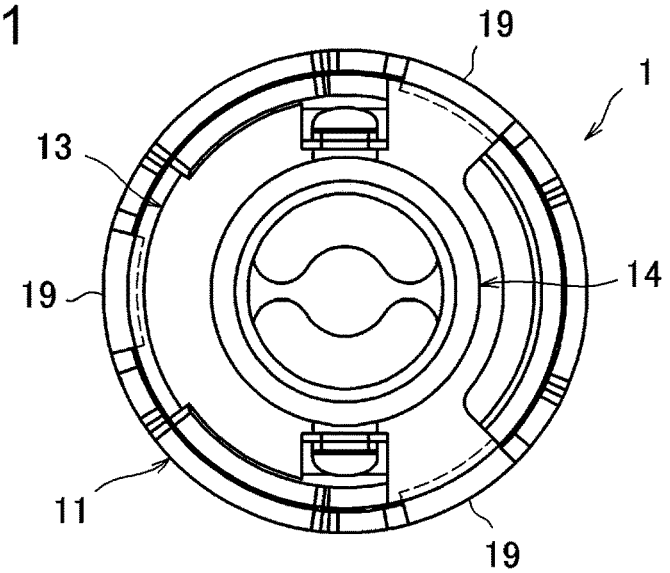
FIG. 21 is a top view of a vapor generation unit determined as non-conforming in the element-contact inspection process, illustrating the condition of the crimping claws of the non-confirming vapor generation unit.
Figure 22:
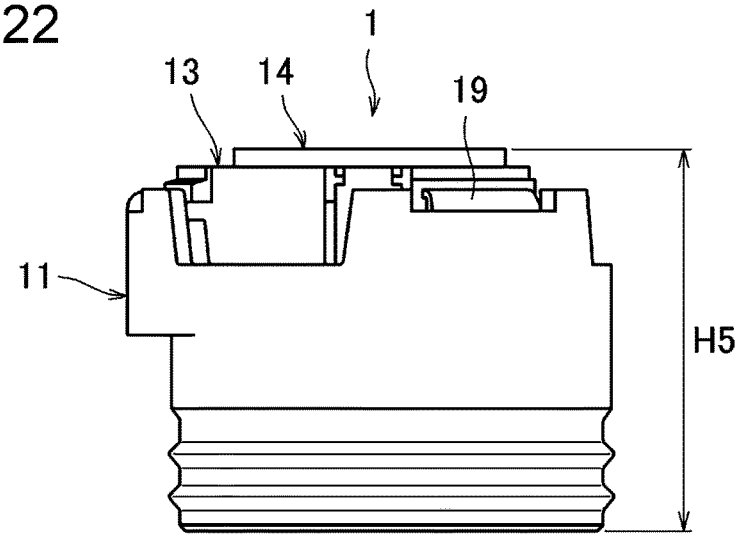
FIG. 22 is a side view of the vapor generation unit depicted in FIG. 21, illustrating the height of the vapor generation unit.

FIG. 21 is a top view of the VGU 1 determined as non-conforming in the element-contact inspection process, illustrating the condition of the crimping claws 19. FIG. 22 is a side view of the VGU 1 depicted in FIG. 21, illustrating a height H5 of the VGU 1. For example, as illustrated in FIG. 21, in some cases, improper crimping of the crimping claws 19 by the heater mounting mechanism 42 may result in the crimping claws 19 not being bent as indicated by broken lines in FIG. 21.

In this case, as illustrated in FIG. 22, the heater 14 does not fit completely within the wick holder 13 but protrudes beyond the wick support 11, with the result that the VGU 1 has the height H5 greater than its normal height H4.

Figure 23:
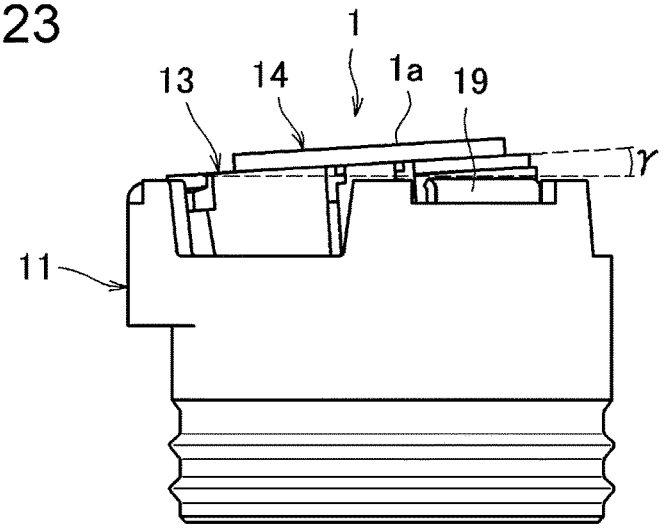
FIG. 23 is a side view of the vapor generation unit whose upper face is inclined.

As illustrated in FIG. 23, in some cases, a failure to bend one of the crimping claws 19 by the heater mounting mechanism 42 may result in an upper face 1*a* of the VGU 1 being inclined at an angle γ with respect to the horizontal direction.

Suitable exemplary methods for detecting such an abnormality in the height of the VGU 1 or inclination of the upper face 1*a* include image recognition performed by imaging the VGU 1 from the side with a camera, and use of a laser displacement meter from above. This enables, without transmission inspection using X-rays or other methods, easy and reliable detection of poor contact between the heater element 24 and the wick 12 based on an excessive assembly error in the VGU 1. The element-contact inspection process may include inspecting the shape of the crimping claws 19 of the VGU 1 from the side or from above to make a detailed assessment of the state of crimping of the crimping claws 19.

Figure 24:
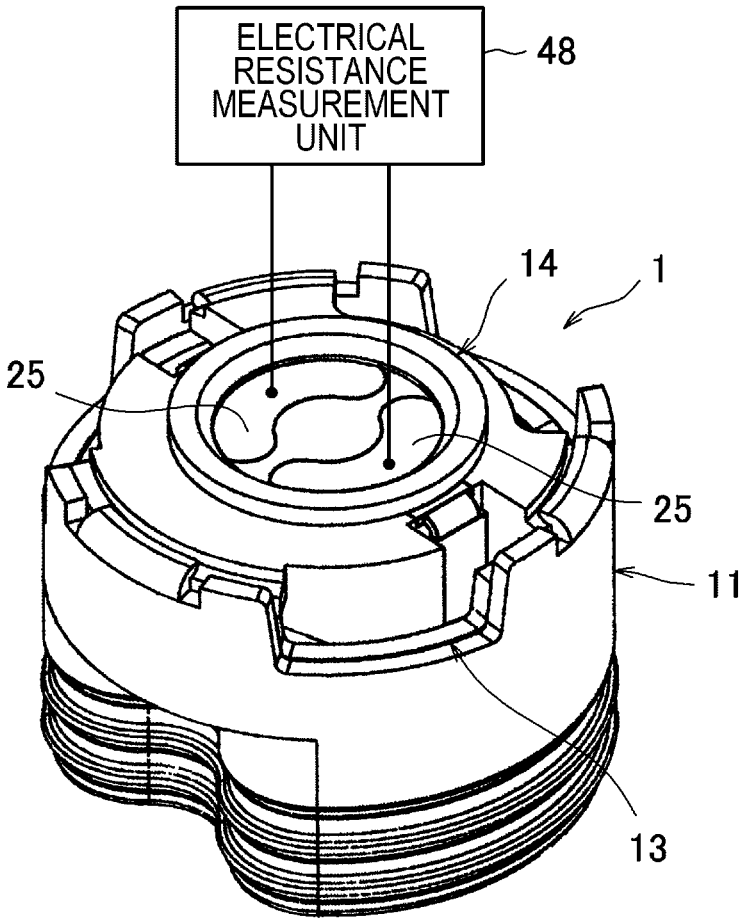
FIG. 24 illustrates another element-contact inspection process.

FIG. 24 illustrates another element-contact inspection process. As illustrated in FIG. 24, an electrical resistance measurement unit 48 may be connected to the pair of electrodes 25 of the completed VGU 1 to inspect the electrical resistance of the VGU 1 (post-assembly resistance inspection). Although this requires introducing a liquid to the wick 12 to wet the wick 12, poor contact between the heater element 24 and the wick 12 can be detected by detection of an abnormal electrical resistance.

As described above, the method for producing the VGU 1 according to the embodiment facilitates the procedure for producing the VGU 1. This allowing for improved reliability and productivity in producing the VGU 1 without compromising the performance of the VGU 1 required for the inhaler 2.

More specifically, the method for producing the VGU 1 according to the embodiment involves first feeding the wick support 11, and then sequentially feeding the other components 12, 13, and 14 toward the wick support 11 in one direction for mounting to the wick support 11. This configuration makes it possible to produce the VGU 1 from the four components 11, 12, 13, and 14, and ensure that the component on which to mount other components is limited to the wick support 11.

Further, the above configuration also helps to ensure that the other components 12, 13, and 14 are fed toward and mounted to the wick support 11 in only one direction. This facilitates automation of the procedure for producing the VGU 1.

Although one embodiment of the present invention has been described above, the foregoing description is not intended to limit the present invention to the particular embodiment described but intended to cover all modifications or alterations that fall within the scope of the present invention.

For example, the various inspection steps and inspection processes in the foregoing description of the embodiment are not limited to the specific forms described but may employ various inspection means, examples of which include camera-based image recognition, laser scanning, X-ray inspection, pressure inspection, flow rate inspection, infrared inspection, ultraviolet inspection, and color inspection.

The VGU 1 is applicable to various non-combustible flavor inhalers, and not strictly intended for application solely to the VGU 1 mentioned above.

Likewise, the components 11, 12, 13, and 14 of the VGU 1 are not limited to the specific shapes and configurations described above.

With the method for producing the VGU 1 mentioned above, the wick support 11 is fed first, and then the other components 12, 13, and 14 are sequentially fed toward the wick support 11 in one direction for mounting to the wick support 11. However, this is not intended to be limiting. It is also possible to assemble one or more sets of components selected from the components 11, 12, 13, and 14 together in advance into an assembly, and fed the assembled component toward a base component or toward an already assembled component as appropriate to thereby produce the VGU 1.

REFERENCE SIGNS LIST

1 vapor generation unit
2 non-combustible flavor inhaler
11 wick support
12 wick (liquid-retaining component)
13 wick holder
14 heater
15 support part
16 liquid introduction opening
17 support face
20 holder part
21 exposed opening
22 holder face
23 exposed face
24 heater element
25 electrode
27 production line
28 wicking material
32 curved face

The invention claimed is:

1. A method for producing a vapor generation unit for a non-combustible flavor inhaler, the vapor generation unit heating a liquid to generate vapor, the vapor generation unit including a wick that retains the liquid, a wick support onto which the wick is placed, a wick holder that, when mounted to the wick support, sandwiches the wick between the wick holder and the wick support and defines an exposed face through which the wick is exposed, and a heater having a heater element, the heater element being brought into contact with the exposed face when the heater is mounted to the wick support, the method comprising:

a support feeding step of feeding the wick support to a production line for the vapor generation unit;

a wick feeding step of, after the support feeding step, feeding the wick toward the wick support to place the wick onto the wick support;

a holder feeding step of, after the wick feeding step, feeding the wick holder toward the wick support to mount the wick holder to the wick support; and a heater feeding step of, after the holder feeding step, feeding the heater toward the wick holder to mount the heater to the wick support.

2. The method according to claim 1 for producing a vapor generation unit for a non-combustible flavor inhaler, wherein the wick support includes a support part, the support part having a liquid introduction opening for introducing the liquid to the wick, and a curved support face defining an opening edge of the liquid introduction opening, and wherein the wick feeding step incudes a wicking-material cutting process of cutting a wicking material into a size that fits the support part, the wicking material being a material of the wick, a wicking-material shaping process of shaping the wicking material cut in the wicking-material cutting process to impart a curved face to the wicking material, the curved face having a curvature that conforms to the support face, and a wick inspection process of inspecting a profile of the wick formed in the wicking-material shaping process.

3. The method according to claim 2 for producing a vapor generation unit for a non-combustible flavor inhaler, further comprising a wick-position inspection step of, after the wick feeding step, inspecting a position of the wick placed on the wick support.

4. The method according to claim 3 for producing a vapor generation unit for a non-combustible flavor inhaler, wherein the wick-position inspection step includes a liquid-introduction-opening inspection of inspecting whether the wick covers the liquid introduction opening, and a support-face inspection of inspecting whether an outer peripheral edge of the wick is aligned with the support face.

5. The method according to claim 4 for producing a vapor generation unit for a non-combustible flavor inhaler, wherein the wick holder includes a holder part, the holder part having an exposed opening and a holder face, the exposed opening defining the exposed face when the wick holder is mounted to the wick support, the holder face defining an opening edge of the exposed opening, the holder face being curved to allow the holder face to sandwich the outer peripheral edge of the wick between the holder face and the support face, and wherein the holder feeding step includes a holder pressing process of, to define the exposed face, pressing the holder face against the support face with a predetermined holder-pressing force.

6. The method according to claim 5 for producing a vapor generation unit for a non-combustible flavor inhaler, wherein the holder-pressing force has a magnitude sufficient to prevent the liquid retained in the wick from leaking through the outer peripheral edge of the wick sandwiched between the support face and the holder face.

7. The method according to claim 6 for producing a vapor generation unit for a non-combustible flavor inhaler, further comprising an exposed-face inspection step of, after the holder feeding step, inspecting a profile of the exposed face.

8. The method according to claim 7 for producing a vapor generation unit for a non-combustible flavor inhaler, wherein the exposed-face inspection step includes an exposed-face inspection of inspecting a condition of the exposed face, an exposed-face curvature inspection of inspecting a radius of curvature of the exposed face, and an exposed-face position inspection of inspecting a position of the exposed face in the wick support.

9. The method according to claim 8 for producing a vapor generation unit for a non-combustible flavor inhaler, wherein the heater includes the heater element, and a pair of electrodes that generate heat upon supply of power, and wherein the heater feeding step includes an element shaping process of shaping the heater element into a shape that conforms to the exposed face, an element securing process of bringing opposite ends of the heater element shaped in the element shaping process into contact with the pair of electrodes to secure the heater element onto the pair of electrodes, and a heater inspection process of inspecting a profile of the heater element secured in the element securing process.

10. The method according to claim 9 for producing a vapor generation unit for a non-combustible flavor inhaler, wherein the heater inspection process includes an element-curvature inspection of inspecting a radius of curvature of the heater element, an element-length inspection of inspecting whether a heat-generating region of the heater element has a predetermined length, and an element-position inspection of inspecting a position of the heater element in the heater, and a resistance inspection of inspecting an electrical resistance provided by the heater element when power is supplied to the pair of electrodes.

11. The method according to claim 10 for producing a vapor generation unit for a non-combustible flavor inhaler, wherein the heater feeding step further includes an element-pressing process of, in mounting the heater to the wick support, pressing the heater element with a predetermined pressing force against the exposed face into contact with the exposed face.

12. The method according to claim 11 for producing a vapor generation unit for a non-combustible flavor inhaler, wherein the element-pressing force has a magnitude that allows an entirety of the heat-generating region of the heater element to come into contact with the exposed face, and prevents a break from occurring in the heater element.

13. The method according to claim 12 for producing a vapor generation unit for a non-combustible flavor inhaler, further comprising an assembly inspection step of, after the heater feeding step, inspecting a state of assembly of the vapor generation unit whose assembly is completed, wherein the assembly inspection step includes an element-contact inspection process of inspecting a state of contact between the exposed face and the heater element.

14. The method according to claim 13 for producing a vapor generation unit for a non-combustible flavor inhaler, wherein the element-contact inspection process includes an assembly error inspection of inspecting a state of contact between the heater element and the wick based on a height of the vapor generation unit in a direction in which the heater element and the wick contact each other, and a post-assembly resistance inspection of inspecting a state of contact between the heater element and the wick based on an electrical resistance, the electrical resistance being an electrical resistance provided by the heater element when power is supplied to the pair of electrodes.

* * * * *